United States Patent [19]

Benton et al.

[11] 4,269,592

[45] May 26, 1981

[54] CONTROL OF COMBUSTIBILITY OF VOLATILE HYDROCARBONS AND PARTICULATE MATTER IN AN EXHAUST GAS STREAM BY USE OF A HIGH VELOCITY BURNER IN A CARBON BAKE RING FURNACE

[76] Inventors: Charles M. Benton, 4320 Landsdowne St.; Franklin D. Arnold, 2200 Venetian Way; Helge O. Forberg, 215 Wildwood Dr., all of Owensboro, Ky. 42301; Roger L. Tuscher, Rte. 1, Box 343; Gerald D. Evrard, Rte. 1, Box 171, both of Cannelton, Ind. 47520

[21] Appl. No.: 119,920

[22] Filed: Feb. 8, 1980

[51] Int. Cl.[3] ..... F27D 7/00; F27B 9/00

[52] U.S. Cl. ..... 432/19; 432/72; 432/145; 432/192

[58] Field of Search ..... 432/19, 72, 145, 192

[56] References Cited

U.S. PATENT DOCUMENTS 4,128,394 12/1978 Naito et al. ..... 432/192

FOREIGN PATENT DOCUMENTS 2505335 8/1976 Fed. Rep. of Germany ..... 432/192

*Primary Examiner*—John J. Camby

*Attorney, Agent, or Firm*—Wilks, Hanegan, Tate, Peacock & Linne

[57] ABSTRACT

The present invention relates to a method of and an apparatus for controlling the combustibility of volatile hydrocarbons and particulate matter in an exhaust gas stream driven off from a carbon product being baked in a furnace. In a prebaking stage, the carbon product is heat treated in a temperature range of 300° C. to 600° C. in order to drive off the volatile hydrocarbons and particulate matter and form the exhaust gas stream. The exhaust gas stream is heated to a temperature of at least 900° C. and at least one heat transfer medium is force-drafted and mixed into the exhaust gas stream so that the stream contains at least approximately 6% oxygen. The volatile hydrocarbons and particulate matter in the exhaust gas stream are combusted into non-polluting compounds having an opacity less than 40% for exhaustion from the furnace into the outside atmosphere.

37 Claims, 5 Drawing Figures

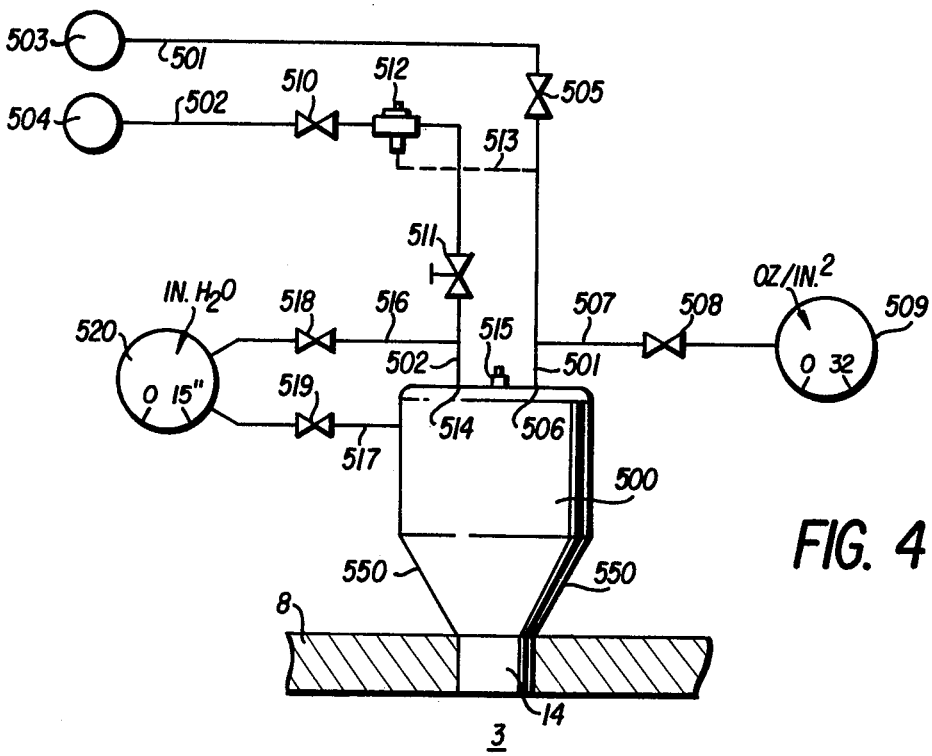
FIG. 4
FIG. 5
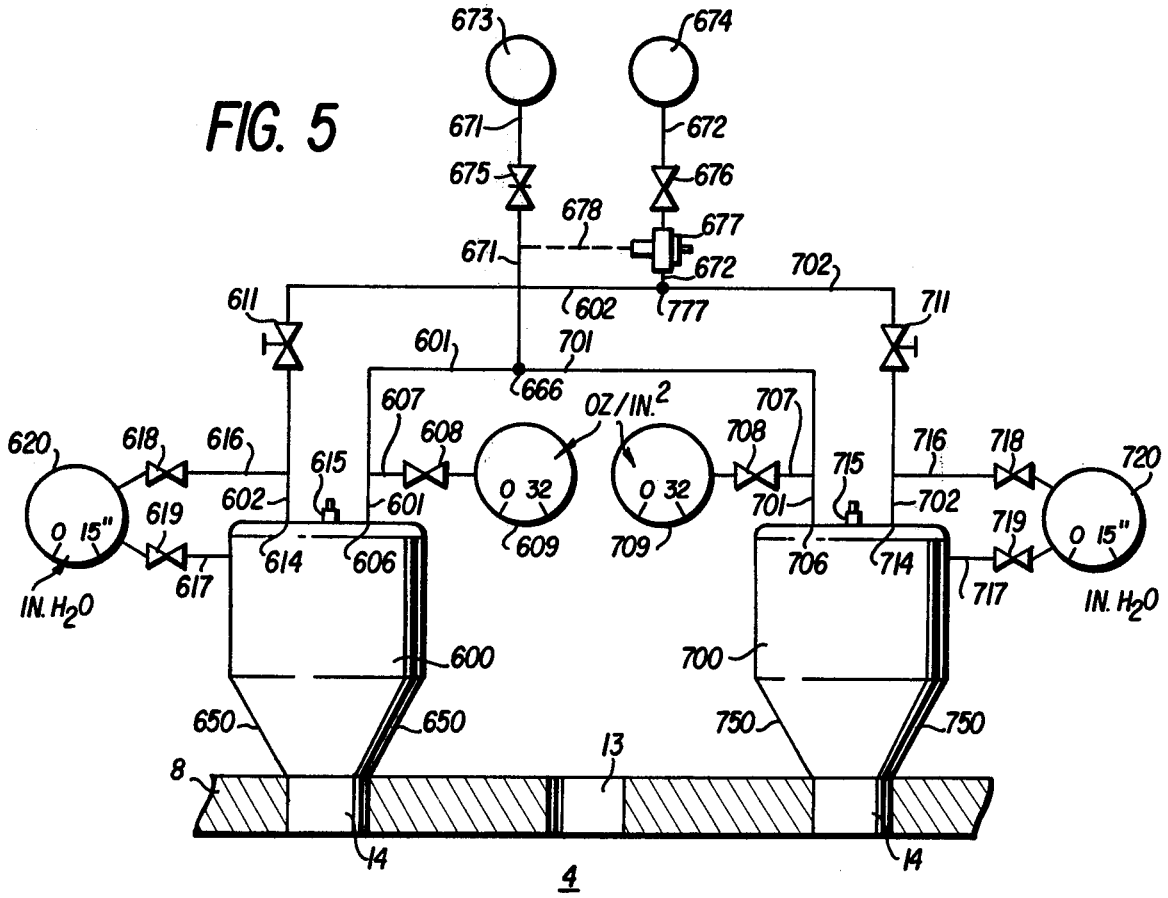

CONTROL OF COMBUSTIBILITY OF VOLATILE HYDROCARBONS AND PARTICULATE MATTER IN AN EXHAUST GAS STREAM BY USE OF A HIGH VELOCITY BURNER IN A CARBON BAKE RING FURNACE

BACKGROUND OF THE INVENTION

1. Field of the Invention

This invention relates to heating and combustion, in particular, to processes and apparatuses for heating and combusting furnace exhaust gases.

2. Description of the Prior Art

Exhaust gases from smokestacks of industrial furnaces are a major source of air pollution. Due to the present national concern about air pollution, the U.S. Congress created the Environmental Protection Agency (hereinafter EPA). This agency has promulgated various regulations governing the permissible industrial emissions into the atmosphere. Most states have established similar agencies which have promulgated identical or more stringent regulations. For example, the Commonwealth of Kentucky has put into effect Title 401, K.A.R. chap. 3:060 (3) (a) 1, which states that the emission of particulate matter into the open air must not exceed 40% opacity, i.e., the emission must not block more than 40% of the light passing through it. Many industrial furnaces in Kentucky are not in compliance with this regulation. Some attempts to clean up or otherwise limit the emissions of particulate matter have been unsatisfactory because of the nature of the heating processes and the combustion apparatuses utilized in the industrial furnaces. Thus, there is need for new combustion apparatuses capable of carrying out heating processes without causing violation of regulations limiting industrial furnace emissions.

Although violations of regulations limiting industrial furnace emissions have been reduced by inserting an afterburner in the smokestack in order to combust the exhaust gases containing hydrocarbons, the use of such an afterburner is expensive an inefficient.

Exemplary prior art industrial furnaces for baking carbon products are shown and described in U.S. Pat. Nos. 2,678,205 and 4,128,394. However, these patents do not disclose any attempts to exhaust only non-polluting compounds into the outside atmosphere either with or without the use of an afterburner.

SUMMARY OF THE INVENTION

The present invention utilizes the primary combustion burner to control the oxygen content in the furnace so that hydrocarbon gases emitted from carbon products being baked in the furnace are combusted therein and, thus, the need for an afterburner in the smokestack is eliminated.

It is a primary object of the invention to control the combustibility of volatile hydrocarbons and particulate matter in an exhaust gas stream driven off from a carbon product being heat treated in a furnace.

It is also an object of the invention to provide a new apparatus for controlling such combustibility so that only non-polluting compounds having an opacity less than 40% are exhausted from the furnace into the outside atmosphere.

These and other objects of the present invention will become more apparent hereinafter. Such objects are accomplished in accordance with the present invention by providing an apparatus and method of baking carbon material which emits hydrocarbon gases when heated to elevated temperatures in such a manner that products of combustion of an air fuel mixture burned in one furnace section contains sufficient oxygen to support combustion of hydrocarbon gases emitted from carbon material contained in another downstream furnace section. Thus, the amount of polluting combusted hydrocarbon gases emitted from the furnace to the outside atmosphere is substantially reduced.

More particularly, the method relates to controlling the combustibility of volatile hydrocarbons and particulate matter in an exhaust gas stream driven off from a carbon product being baked in a furnace. The method comprises the steps of heating the exhaust gas stream containing the volatile hydrocarbons and particulate matter to a temperature of at least 900° C., force-drafting and mixing at least one heat transfer medium into the exhaust gas stream so that the exhaust gas stream contains at least approximately 6% oxygen, combusting the volatile hydrocarbons and particulate matter into non-polluting compounds, and exhausting the non-polluting compounds from the furnace into the outside atmosphere.

Also, more particularly, the apparatus relates to the control of the combustibility of the volatile hydrocarbons and particulate matter in the exhaust gas stream driven off from the carbon product being baked in the furnace. The apparatus comprises means for heating the exhaust gas stream containing the volatile hydrocarbons and particulate matter to a temperature of at least 900° C., means for force-drafting and mixing at least one heat transfer medium into the exhaust gas stream so that the exhaust gas stream contains at least approximately 6% oxygen, means for combusting the volatile hydrocarbons and particulate matter into non-polluting compounds, and means for exhausting the non-polluting compounds from the furnace into the outside atmosphere.

BRIEF DESCRIPTION OF THE DRAWINGS

FIG. 4 is a schematic view of a high velocity burner utilized in the third prebaking stage for the carbon products; and FIG. 5 is a schematic view of a plurality of high velocity burners utilized in the baking stage for the carbon products.

DETAILED DESCRIPTION OF THE PREFERRED EMBODIMENT

Figure 1:
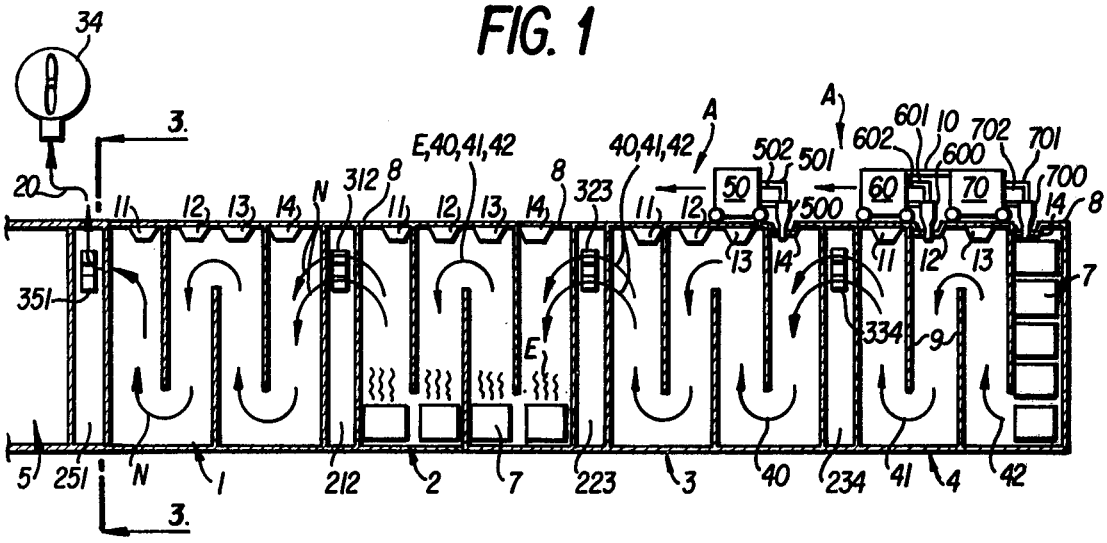
FIG. 1 is a side view taken through a plurality of furnace sections forming adjacent links in an oval-shaped ring furnace utilized for baking carbon products.

In the drawing figures, a preferred embodiment of the furnace for carrying out the inventive method is illustrated. In FIG. 2, a plurality of furnace sections 1–5 are interconnected and form adjacent links in an oval-shaped ring 6 arranged for baking stacked rows of carbon products 7 shown in FIGS. 1 and 3. As seen from overhead in FIG. 2, the sections 1–4 comprise one of many fire groups in the furnace that give the ring 6 its oval shape.

Each carbon product 7 may be a 1,700 pound anode utilized as an electrical conductor to reduce alumina to aluminum in an operation to be carried out elsewhere after the anode is baked. However, in order to first form the anode, it is necessary to hot press amorphous carbon that is binded into a block by a suitable pitch, such as coal tar, which consists of particulate matter and volatile hydrocarbons having molecular weights over 3,000. The carbon products 7 are stacked in rows in at least four sections 1–4 before the heating and baking processes begin. Such rows of carbon products 7 are shown partially arranged in sections 2 and 4 in FIG. 1 and in section 1 in FIG. 3. During the second prebaking stage carried out in section 2, the heated carbon products 7 give off an exhaust gas stream E consisting of the volatile hydrocarbons and particulate matter. See FIG. 1.

Figure 2:
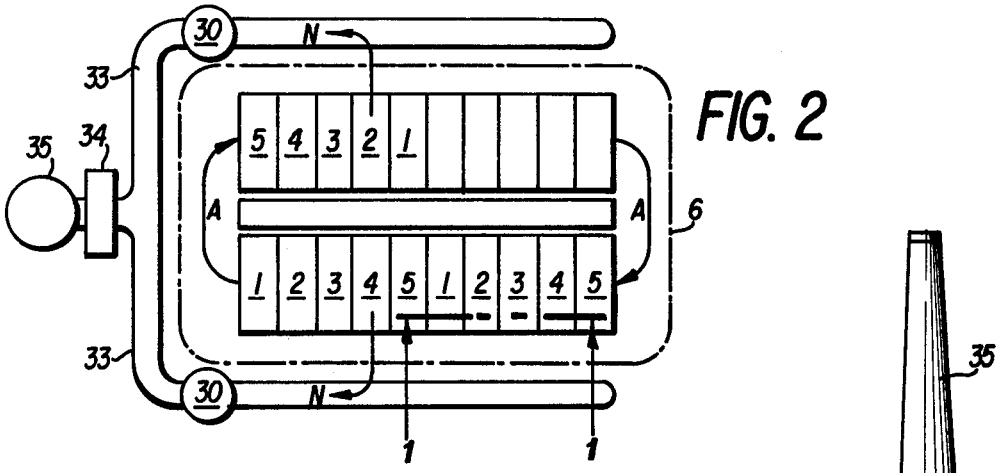
FIG. 2 is a top plan view of the furnace formed by the links of the oval-shaped ring.

As shown in the side view in FIG. 1, each section 1–4 has a plurality of observation points or peephole rows 11–14 for viewing the interior of the furnace. Each peephole row, e.g., row 11, includes a plurality of individual peepholes (not shown) which are arranged on the top 8 of each section 1–4 thereacross. Each row of individual peepholes are at ground level G and each section 1–4 is an underground pit insulated at its sides and bottom by refractory bricks and earth. Each section 1–4 is divided from the adjoining section by a thick wall shown in FIG. 1 as 251, 212, 223 and 234 made of refractory brick. In each wall 251, 212, 223, 234, there is an opening 351, 312, 323, 334, respectively, near the top 8 of the two adjoining sections so that heat transfer mediums 40, 41, 42, and non-polluting compounds N may pass therethrough to the next section in the ring 6. Inside each wall 251, 212, 223, and 234, there is a plurality of parallel headwall openings 111–117 and, inside each section 1–4, there are flues with vertically oriented baffles 9 which separate each stacked row of carbon products 7 from the adjacent stacked row. These baffles 9 form a W-shaped pattern within each section 1–4 so that the heat transfer mediums 40, 41, 42 circulate completely and distribute heat evenly throughout each such section 1–4.

Figure 3:
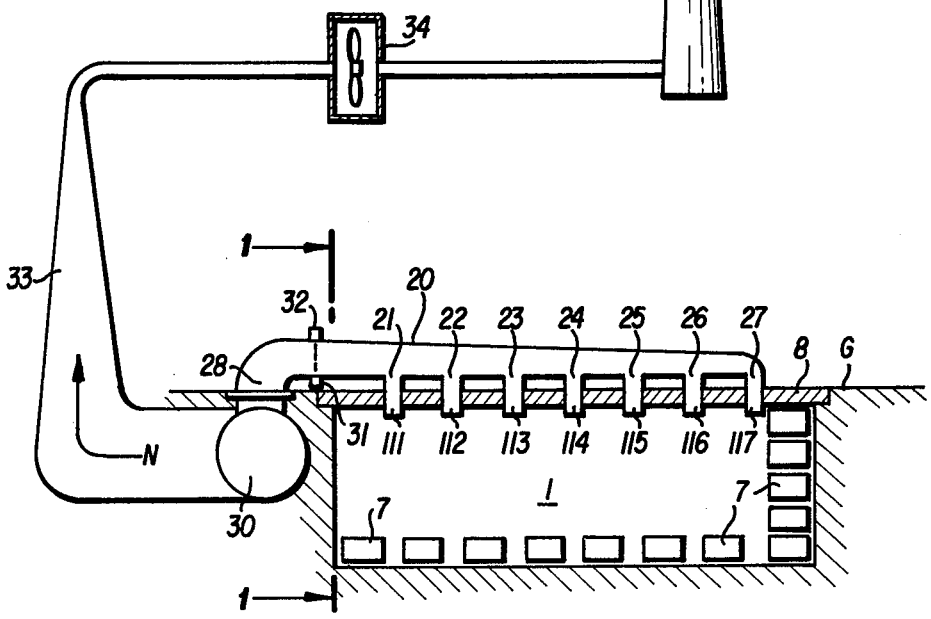
FIG. 3 is a cross-sectional view taken along line 3—3 of FIG. 1 through one of the furnace sections with the exhaust system shown schematically.

An exhaust manifold 20 is best illustrated in FIG. 3 and is shown to be connected to a plurality of exhaust points 21–27 in headwall openings 111–117 of the wall 251 shown in FIG. 1. The exhaust manifold 20 is movable from the exhaust points 21–27 of wall 251 to those of the next wall (unnumbered) shown in FIG. 2 between sections 5 and 4. The exhaust manifold 20 is attached at its exit end 28 shown in FIG. 3 to one end of damper 30 which is arranged preferably underground in order to eliminate bulky obstruction to the equipment and persons working above the ground G. Also as shown in FIG. 3, a light source 31 is arranged in the exhaust manifold 20. Before the non-polluting compounds N pass through damper 30, a smoke detector 32 of the photoelectric type measures the opacity of the emissions.

A long plenum 33 is attached to the downstream end of the damper 30 and leads to a fan 34 which, in turn, leads to a smokestack 35 for exhausting the non-polluting compounds N to the outside atmosphere. See FIGS. 2 and 3.

Traveling along on the top 8 of the sections 1–4 is a plurality of racks 50, 60 and 70 shown in FIG. 1. As shown in FIGS. 1 and 2, these racks 50, 60 and 70 are moved in the direction of arrow A by suitable means around the circumference of the oval-shaped ring 6 of the furnace.

As shown in FIG. 1, rack 50 carries a prebaking burner 500 which force-drafts the heat transfer medium 40 into peephole row 14 in furnace 3. An air line 501 and a fuel line 502 supply air and fuel, respectively, to the prebaking burner 500.

As shown in FIG. 1, racks 60 and 70 carry baking burners 600 and 700, respectively, which force-draft additional heat transfer mediums 41 and 42 into peehole rows 12 and 14, respectively, in furnace 4. Racks 60 and 70 are joined together by a joint 10 so that they travel in unison and may be picked up together. Air lines 601 and 701 and fuel lines 602 and 702 supply air and fuel, respectively, to baking burner 600 and 700, respectively.

When racks 60 and 70 are moved along the top 8 of the sections, e.g., from section 4 to 3, rack 50 is also moved, e.g., from section 3 to 2. Likewise, exhaust manifold 20 is moved from wall 251 adjoining sections 1 and 5 to the wall (unnumbered) adjoining sections 5 and 4. See FIG. 2.

In the more detailed illustration of prebaking burner 500 in FIG. 4, compressed air source 503 supplies air line 501 while pressurized fuel source 504 supplies fuel line 502. A butterfly valve 505 is arranged in the air line 501 between the air source 503 and the point 506 through which the air exits air line 501 and enters prebaking burner 500. Air line 501 is also connected to an air test line 507 having therein an air test valve 508 leading to a pressure gauge 509 for measuring the air pressure, preferably in ounces per square inch (oz./in.$^2$).

Fuel line 502 has a safety valve 510 and an adjustable orifice valve 511 therein for adjusting or cutting off the flow of fuel to the prebaking burner 500 in an emergency. The type of fuel utilized by the prebaking burner 500 may be either natural gas or light fuel oil.

A regulator 512 is connected into fuel line 502, preferably between the safety valve 510 and the adjustable orifice valve 511, and maintains the air and fuel entering the prebaking burner 500 at a constant preset volume ratio. The regulator 512 is activated by an impulse line 512 connected to the air line 501. The monitored fuel exits fuel line 502 at point 514 and enters prebaking burner 500. Push button-operated ignition switch 515 ignites the fuel/air mixture in the prebaking burner 500.

Just in front of point 514 there is an upstream fuel test line 516 connected into fuel line 502. Just beyond the point 514, there is a downstream fuel test line 517 connected into the prebaking burner 500. Upstream fuel test line 516 and downstream fuel test line 517 have test valves 518 and 519, respectively, connected therein and leading to a conventional magnehelic gauge 520 for measuring the difference in fuel pressure in inches of water (in.$H_2O$).

In the more detailed illustration of baking burners 600 and 700 in FIG. 5, compressed air source 673 supplies air line 671 which divides at point 666 into air line 601 leading to baking burner 600 and air line 701 leading to baking burner 700. Pressurized fuel source 674 supplies fuel line 672 which divides at point 777 into fuel line 602 leading to baking burner 600 and fuel line 702 leading to baking burner 700. A butterfly valve 675 is arranged in the air line 671 between the air source 673 and the point 666. Air lines 601 and 701 are connected to air test lines 607 and 707, respectively, which have respective air test valves 608 and 708 leading to respective pressure gauges 609 and 709 for measuring the air pressure, again preferably in oz./in.$^2$. At points 606 and 706, air exits respective air lines 601 and 701 and enters respective baking burners 600 and 700.

Fuel line 672 has a safety valve 676 and fuel lines 602 and 702 have adjustable orifice valves 611 and 711, respectively, for adjusting or cutting off the flow of fuel to the respective baking burners 600 and 700 in an emergency. The same type of fuel is utilized in baking burners 600 and 700 as is used in prebaking burner 500.

A single ratio regulator 677 is connected into fuel line 672, preferably between the safety valve 676 and the point 777. Thus, the need for two ratio regulators in each fuel line 602 and 702 is eliminated. The regulator 677 maintains the air and fuel in the baking burners 600 and 700 at a constant preset volume ratio and is activated by an impulse line 678 connected to the air line 671. The monitored fuel exits fuel lines 602 and 702 at points 614 and 714, respectively, and enters respective baking burners 600 and 700. Push button-operated ignition switches 615 and 715 ignite the air/fuel mixtures in respective baking burners 600 and 700.

Just in front of the points 614 and 714, there are upstream fuel test lines 616 and 716 connected into respective fuel lines 602 and 702. Just beyond the points 614 and 714, there are respective downstream fuel test lines 617 and 717 connected into the respective baking burners 600 and 700. Upstream fuel test lines 616 and 716 and downstream fuel test lines 617 and 717 have test valves 618, 718, 619, 719, respectively, connected therein and leading to respective conventional magnehelic gauges 620 and 720 for measuring the difference in fuel pressure in inches of water (in.$H_2O$).

A preferred unit for high velocity prebaking burner 500 is manufactured by North American Mfg. Co., Cleveland, Ohio, and is identified by model no. 4442A-4S. Preferred units for high velocity baking burners 600 and 700 are manufactured by the same company and are identified by model no. 4442A-4. Such models for both types of burners are the subject matter described and claimed in U.S. Pat. No. 3,666,393, issued on May 30, 1972, in the name of Theodore E. Davies and entitled "Burner, Structure and Method."

The operation of the method and apparatus is as follows. Initially, the carbon products 7 are placed in stacked rows in at least four sections 1–4 in the oval-shaped ring 6 of fire-groups shown in FIG. 2. In FIG. 1, the exhaust manifold 20 is arranged so that the plurality of exhaust points 21–27 are aligned in the individual headwall openings 111–117 in FIG. 3. As best seen in FIG. 1, rack 50 is arranged over peephole row 14 of section 3 while racks 60 and 70 are arranged over peephole rows 12 and 14, respectively, of section 4. Thus, a plurality of prebaking burners 500 and baking burners 600 and 700 project into individual peepholes in the respective rows 14 of section 3 and rows 12 and 14 of section 4.

Once the exhaust manifold 20 and the racks 50, 60, and 70 are properly arranged, the prebaking burners 500 and the baking burners 600 and 700 may be started by the fireman. This startup operation is begun by first turning on the fuel safety valves 510 and 676, shown schematically in FIGS. 4 and 5, respectively. Butterfly valves 505 and 675, also shown schematically in FIGS. 4 and 5, respectively, are opened so that compressed air passes from the air sources 503 and 673 through air lines 501 and 671, respectively into prebaking burner 500 and baking burners 600 and 700, respectively. Adjustable orifice valves 511, 611 and 711 in fuel lines 502, 602 and 702, respectively, are opened so that pressurized fuel passes from fuel sources 504 and 674, respectively into burners 500, 600 and 700, respectively. Ignition switches 515, 615, and 715, which may be operated by push buttons, are activated so that the air/fuel mixtures in burners 500, 600 and 700 are combusted.

The ratio of air to fuel is automatically controlled by regulators 512 and 677 which draw off small amounts of air from air lines 501 and 671, respectively, via impulse lines 513 and 678, respectively, for comparison with the fuel passing through fuel lines 502 and 672, respectively.

Preferably, baking burners 600 and 700 run with ten (10) parts by weight of air to one (1) part by weight of fuel if natural gas is used as fuel. The plurality of prebaking burners 500 are preferably run with eleven (11) parts by weight of air to one (1) part by weight of natural gas.

The air/fuel mixtures combusted in burners 500, 600 and 700 form products of combustion or heat transfer mediums 40, 41 and 42, respectively, in FIG. 1. Turbulent flow is induced because of the internal configuration of the burners 500, 600 and 700. See FIGS. 4 and 5. As may be best seen in these Figures, the air and fuel enter burners 500, 600 and 700 straight through points 506, 514, 606, 614, 706 and 714, respectively, and strike side walls 550, 650 and 750. After bouncing off walls 550, 650 and 750, the air and fuel mix together turbulently in each burner 500, 600 and 700, before being force-drafted through peephole row 14 into section 3 and through peephole rows 12 and 14 into section 4, respectively. Alternatively, the turbulent mixing together of air and fuel to form the heat transfer mediums 40, 41 and 42 may be induced by aligning air lines 501, 601 and 701 at various angles to respective fuel lines 502, 602 and 702 at points 506 and 514, 606 and 614, and 706 and 714, respectively. Thus, the heat transfer mediums 40, 41 and 42, respectively, are formed just beyond the points 506 and 514, 606 and 614, and 706 and 714, respectively, inside burners 500, 600 and 700, respectively. For example, such alignment may be accomplished by orienting either the air or fuel line parallel to the longitudinal axis of the burner that it feeds while the corresponding fuel or air line is oriented at an angle inclined towards the longitudinal axis of the same burner. Also, such alignment may be accomplished by orienting both air and fuel lines at opposite angles inclined toward the longitudinal axis of the same burner that both lines feed.

Heat transfer mediums 40, 41 and 42 are force-drafted from burners 500, 600 and 700, respectively, into sections 3 and 4 at high velocities up to 200 miles per hour. Such high velocities are made possible by the natural expansion of the heated products of combustion of the air/fuel mixture. Because the temperature of the air/fuel mixture is raised approximately 1,000° C. inside the burner from room temperature outside the burner, the volume of the air/fuel mixture expands at a rapid rate, thus causing such high velocities.

Once the heat transfer mediums 40, 41 and 42 enter sections 3 and 4, respectively, in turbulent flow at high velocities, the heat transfer mediums 40, 41 and 42 are aided in their heat distribution to the carbon products 7 in all sections 1–7 and to the exhaust gas stream E in section 2 by baffles 9 which are arranged in the W-shaped pattern shown in FIG. 1. The baffles 9 help distribute the heat from the heat transfer mediums 40, 41 and 42 at a substantially uniform rate through the sections 1–4. This even distribution of heat throughout the sections 1–4 avoids the creation of relatively hot and cold spots therein and gives a uniform quality to the baked carbon products 7. Thus, the useful life of the flues is also increased because the uniform temperature caused by such distribution prevents the refractory bricks from being damaged by such hot spots.

As shown in FIG. 1, the baking stage of the carbon products 7 is carried out in section 4 in a temperature range of 900° C. to 1100° C. for 48 hours. Such high temperatures are maintained by baking burners 600 and 700. Heat transfer mediums 41 and 42, force-drafted from baking burners 600 and 700 into section 4, pass through opening 334 in wall 234 and enter section 3 where they join the heat transfer medium 40 from prebaking burner 500. A third prebaking stage of the carbon products 7 is carried out in section 3 in a temperature range of 600° C. to 900° C. for 48 hours.

Heat transfer mediums 40, 41 and 42 pass from section 3 through opening 323 in wall 223 to section 2 where they mix with the hydrocarbon gases in the form of an exhaust gas stream E being emitted or otherwise driven off from the carbon products 7 heat treated therein to remove volatile hydrocarbons, such as $C_{18}H_{10}$, and the particulate matter. In this prebaking stage, the temperature of the carbon products 7 is in the range of 300° C. to 600° C. for 48 hours, but exhaust gas stream E is heated to a temperature of approximately 900° C. The force-drafting and mixing of the heat transfer mediums 40, 41 and 42 into the exhaust gas stream E results in the exhaust gas stream E containing at least approximately 6% oxygen which is minimally sufficient for combustion of the volatile hydrocarbons of high molecular weight and the particulate matter. Optimum results of about 99% reduction of the hydrocarbons are obtained if there is approximately 10% oxygen in the exhaust gas stream R. The combustion of volatile hydrocarbons and particulate matter in section 2 creates non-polluting compounds N which pass through the opening 312 in wall 212 into section 1 where the first prebaking stage of the carbon products 7 takes place in a range from room temperature to 300° C. for 48 hours.

As shown in FIGS. 2 and 3, non-polluting compounds N, mainly carbon dioxide ($CO_2$), and water vapor ($H_2O$), pass upwardly through headwall openings 111–117 into exhaust points 21–27 in exhaust manifold 20. Before the non-polluting compounds N pass through the damper 30, the opacity of the non-polluting compounds N is measured by the smoke detector 32 which is preferably of the photoelectric type. The smoke detector 32 is mounted on the circumference of the exhaust manifold 20 and measures the amount of light that passes through the non-polluting compounds N from the light source 31 which is mounted at 180° from the smoke detector 32 on the opposite side of the circumference of the exhaust manifold 20.

As mentioned hereinabove, the Commonwealth of Kentucky requires that the emission of particulate matter into the open air must not exceed 40% opacity. The method and apparatus of the present invention has reduced the opacity of such emissions into a range of 5% to 20%.

The damper 30 aids in the maintenance of the heat transfer mediums 40, 41 and 42 at an approximately constant velocity through sections 1–4. When the damper 30 is opened fully, the heat transfer mediums 40, 41 and 42 are aided in maintaining an approximately constant velocity by the pull of the fan 34. When the damper 30 is almost closed, the heat transfer mediums 40, 41 and 42 are hardly affected by the pull of the fan 34 and, thus, there is little or no aid in maintaining the heat transfer mediums 40, 41 and 42 at an approximately constant velocity.

After passing through the damper 30, the non-polluting compounds N enter the plenum 33 and are drawn by the fan 34. See FIGS. 2 and 3. The effect of the pull of the fan 34 may be adjusted by the damper 30. Preferably, depending upon the size of the fan 34, the damper 30 is adjusted so that the heat transfer mediums 40, 41 and 42 are maintained in a pressure range of 0.05 to 0.20 inches of water. Such a range is preferred because it creates the negative pressure conditions in the second prebaking stage of section 2 for the complete combustion of the volatile hydrocarbons and particulate matter in the exhaust gas stream E driven off from the carbon products 7.

After passing through the fan 34, the non-polluting compounds N are drawn up the smokestack 35 by the natural draft therein and, thus, they are exhausted to the outside atmosphere without violating any pollution emission standards.

The foregoing preferred embodiment is considered illustrative only. Numerous modifications will readily occur to those skilled in the art.

What we claim is:

1. A method of controlling the combustibility of volatile hydrocarbons and particulate matter in an exhaust gas stream driven off from a carbon product being baked in a furnace, comprising the steps of:

a. heating the exhaust gas stream containing the volatile hydrocarbons and particulate matter to a temperature of at least 900° C.;

b. force-drafting and mixing at least one heat transfer medium into the exhaust gas stream so that the exhaust gas stream contains at least approximately 6% oxygen; while forming the at least one heat transfer medium by a series of substeps including:

(i) supplying air to at least one high velocity burner means for combusting the volatile hydrocarbons and particulate matter;

(ii) supplying fuel to said at least one high velocity burner means;

(iii) maintaining the air and fuel in said at least one high velocity burner means at a constant preset volume ratio via a regulator connected to a line means for supplying said fuel;

(iv) activating the regulator via an impulse line connected to a line means for supplying said air;

(v) combusting the air/fuel mixture in said at least one high velocity burner means in order to form the at least one heat transfer medium;

c. combusting the volatile hydrocarbons and particulate matter into non-polluting compounds; and d. exhausting the non-polluting compounds from the furnance into the outside atmosphere.

2. A method of controlling the combustibility of volatile hydrocarbons and particulate matter in an exhaust gas stream driven off from a carbon product being baked in a furnace, comprising the steps of:

a. heating the exhaust gas stream containing the volatile hydrocarbons and particulate matter to a temperature of at least 900° C.;

b. force-drafting and mixing at least one heat transfer medium into the exhaust gas stream so that the exhaust gas stream contains at least approximately 6% oxygen; while maintaining the at least one heat transfer medium between a minimum pressure of approximately 0.05 inches of water and a maximum pressure of approximately 0.20 inches of water;

c. combusting the volatile hydrocarbons and particulate matter into non-polluting compounds; and d. exhausting the non-polluting compounds from the furnance into the outside atmosphere.

3. The method, according to claim 1 or 2, further comprising the step of:

heat treating the carbon product in a prebaking stage in a temperature range of 300° C. to 600° C. in order to drive off the volatile hydrocarbons and particulate matter forming the exhaust gas stream.

4. The method according to claim 1 or 2, wherein:

said at least one heat transfer medium is force-drafted from a burner means for combusting the volatile hydrocarbons and particulate matter.

5. The method, according to claim 1 or 2, further comprising the step of:

inducing turbulent flow of the at least one heat transfer medium into the furnace.

6. The method, according to claim 1 or 2, further comprising the step of:

distributing heat from the at least one heat transfer medium at a substantially uniform rate through the furnace.

7. The method, according to claim 1 or 2, further comprising the step of:

maintaining the at least one heat transfer medium at an approximately constant velocity in the furnace.

8. The method, according to claim 1 or 2, wherein:

said non-polluting compounds have an opacity less than 40%.

9. The method, according to claim 1 or 2, wherein:

said exhaust gas stream contains approximately 10% oxygen.

10. An apparatus for controlling the combustibility of volatile hydrocarbons and particulate matter in an exhaust gas stream driven off from a carbon product being baked in a furnace, comprising:

a. means for heating the exhaust gas stream containing the volatile hydrocarbons and particulate matter to a temperature of at least 900° C.;

b. means for force-drafting and mixing at least one heat transfer medium into the exhaust stream so that the exhaust gas stream contains at least approximately 6% oxygen; and further including:

(i) means for supplying air to the combusting means;

(ii) means for supplying fuel to the combusting means;

(iii) means for maintaining the air and fuel in said combusting means at a constant volume ratio; and (iv) means for activating the maintaining means;

c. means for combusting the volatile hydrocarbons and particulate matter into non-polluting compounds; and d. means for exhausting the non-polluting compounds from the furnace into the outside atmosphere.

11. The apparatus, according to claim 10, wherein:

said maintaining means is a regulator connected to said fuel supplying means.

12. The apparatus according to claim 10, wherein:

said activating means is an impulse line connected to said air supplying means.

13. An apparatus for controlling the combustibility of volatile hydrocarbons and particulate matter in an exhaust gas stream driven off from a carbon product being baked in a furnace, comprising:

a. means for heating the exhaust gas stream containing the volatile hydrocarbons and particulate matter to a temperature of at least 900° C.;

b. means for force-drafting and mixing at least one heat transfer medium into the exhaust stream so that the exhaust gas stream contains at least approximately 6% oxygen; and further including means for maintaining the at least one heat transfer medium between a minimum pressure of approximately 0.05 inches of water and a maximum pressure of approximately 0.20 inches of water;

c. means for combusting the volatile hydrocarbons and particulate matter into non-polluting compounds; and d. means for exhausting the non-polluting compounds from the furnace into the outside atmosphere.

14. The apparatus according to claim 10 or 13, further comprising:

means for inducing turbulent flow of the at least one heat transfer medium into the furnace.

15. The apparatus, according to claim 10 or 13, further comprising:

means for aiding the maintainence of the at least one heat transfer medium at an approximately constant velocity in the furnace.

16. The apparatus according to claim 10 or 13, further comprising:

means for aiding the distribution of heat from the at least one heat transfer medium at a substantially uniform rate through the furnace.

17. The apparatus, according to claim 10 or 13, wherein:

said exhaust gas stream contains approximately 10% oxygen.

18. The apparatus, according to claim 10 or 13, wherein:

said means for combusting the volatile hydrocarbons and particulate matter is at least one high velocity burner.

19. An apparatus for baking material which emits hydrocarbon gases when heated to elevated temperatures, comprising:

a. a furnace including a plurality of interconnected sections;

b. means for burning an air/fuel mixture in at least one of the interconnected sections in order to directly bake the material contained therein; and further including:

(i) means for supplying air to the burning means;

(ii) means for supplying fuel to the burning means;

(iii) means for maintaining the air and fuel in the burning means at a constant volume ratio; and (iv) means for activating the maintaining means c. means for conveying products of combustion of the air/fuel mixture through another of the plurality of interconnected sections into contact with the material prior to its being directly baked by the burning means, said material emitting hydrocarbon gases when it is heated;

wherein the products of combustion of the air/fuel mixture contain sufficient oxygen to support combustion of the hydrocarbon gases emitted from the material contained in the other of the plurality of interconnected sections so that the amount of the hydrocarbon gases emitted from the furnace to the outside atmosphere is reduced.

20. The apparatus, according to claim 19, further comprising:

means for exhausting combusted hydrocarbon gases emitted from the material contained in the other of the plurality of interconnected sections from the furnace to the outside atmosphere.

21. The apparatus, according to claim 20, wherein: said combusted hydrocarbon gases exhausted to the outside atmosphere have an opacity less than 40%.

22. The apparatus, according to claim 19, wherein: said burning means is at least one high velocity burner.

23. The apparatus, according to claim 19, wherein: said maintaining means is a regulator connected to the fuel supplying means.

24. The apparatus, according to claim 19, wherein: said activating means is an impulse line connected to the air supplying means.

25. The apparatus according to claim 19, further comprising:

means for inducing turbulent flow into the furnace.

26. The apparatus, according to claim 19, further comprising:

means for aiding the distribution of heat at a substantially uniform rate through the furnace.

27. The apparatus, according to claim 19, wherein: said products of combustion of the air/fuel mixture contain approximately 10% oxygen.

28. A method of baking material which emits hydrocarbon gases when heated to elevated temperatures, comprising the steps of:

a. loading material which emits hydrocarbon gases when heated to elevated temperatures into a furnace including a plurality of interconnected sections for baking;

b. burning an air/fuel mixture in at least one of the interconnected sections in order to directly bake the material contained therein; and c. conveying products of combustion of the air/fuel mixture through another of the plurality of interconnected sections into contact with the material contained therein in order to heat said material prior to its being directly baked, said material emitting hydrocarbon gases when it is heated;

wherein the products of combustion of the air/fuel mixture contain sufficient oxygen to support combustion of the hydrocarbon gases emitted from the material contained in the other of the plurality of interconnected sections so that the amount of the hydrocarbon gases emitted from the furnace to the outside atmosphere is reduced.

29. The method, according to claim 29, wherein: said products of combustion of the air/fuel mixture contain approximately 10% oxygen.

30. The method, according to claim 28, further comprising the step of:

heat treating the material contained in the other of the plurality of interconnected sections in a temperature range of 300° C. to 600° C. in order to cause emission of the hydrocarbon gases from said material.

31. The method, according to claim 28, further comprising the step of:

exhausting combusted hydrocarbon gases emitted from the material contained in the other of the plurality of interconnected sections from the furnace to the outside atmosphere.

32. The method, according to claim 28, further comprising the steps of:

(i) supplying air to at least one high velocity means for burning the hydrocarbon gases emitted from the material;

(ii) supplying fuel to said at least one high velocity burning means;

(iii) maintaining the air and fuel in said at least one high velocity burning means at a constant preset volume ratio via a regulator connected to a line means for supplying said fuel; and (iv) activating the regulator via an impulse line connected to a line means for supplying said air.

33. The method, according to claim 28 further comprising the step of:

inducing turbulent flow in the furnace.

34. The method, according to claim 28, further comprising the step of:

distributing heat at a substantially uniform rate through the furnace.

35. The method, according to claim 28, further comprising the step of:

maintaining the products of combustion of the air/fuel mixture at an approximately constant velocity in the furnace.

36. The method, according to claim 28, wherein: said combusted hydrocarbon gases exhausted to the outside atmosphere have an opacity less than 40%.

37. The method, according to claim 28, further comprising the step of:

maintaining the products of combustion of the air/fuel mixture between a minimum pressure of approximately 0.05 inches of water and a maximum pressure of approximately 0.20 inches of water.

* * * * *